US007128520B2

(12) United States Patent
Monti

(10) Patent No.: US 7,128,520 B2
(45) Date of Patent: Oct. 31, 2006

(54) METHOD AND A DEVICE FOR TRANSFERRING ARTICLES, IN PARTICULAR BLISTER PACKS, TO THE FEEDING LINE OF A PACKAGING MACHINE

(75) Inventor: Giuseppe Monti, Bologna (IT)

(73) Assignee: Marchesinl Group S.p.A., Bologna (IT)

( * ) Notice: Subject to any disclaimer, the term of this patent is extended or adjusted under 35 U.S.C. 154(b) by 0 days.

(21) Appl. No.: 10/302,118

(22) Filed: Nov. 22, 2002

(65) Prior Publication Data

US 2003/0099536 A1 May 29, 2003

(30) Foreign Application Priority Data

Nov. 23, 2001 (IT) ..... BO2001A0713

(51) Int. Cl.
*B65G 57/03* (2006.01)
*B65H 29/26* (2006.01)

(52) U.S. Cl. ..... 414/794.2; 414/798.6; 198/468.1; 198/468.7; 198/725

(58) Field of Classification Search ..... 414/794.2, 414/798.9; 198/468.1, 468.7, 468.9, 725; 53/531, 535, 540, 520
See application file for complete search history.

(56) References Cited

U.S. PATENT DOCUMENTS

| | | | | |
|---|---|---|---|---|
| 4,137,604 A | | 2/1979 | Sandberg et al. | |
| 4,558,779 A | * | 12/1985 | Schmitt et al. | 198/468.7 |
| 4,845,921 A | | 7/1989 | Miselli | 53/453 |
| 5,405,240 A | * | 4/1995 | Uno | 414/794.2 |
| 5,476,361 A | * | 12/1995 | Uno | 414/790.3 |

* cited by examiner

*Primary Examiner*—Gene O. Crawford
*Assistant Examiner*—Gregory Adams

(74) *Attorney, Agent, or Firm*—William J Sapone; Coleman Sudol Sapone PC

(57) ABSTRACT

According to a method for transferring articles, the articles, in particular blister packs, are transferred to a feeding line of a packaging machine, moving continuously and longitudinally with respect to an outlet line of a machine producing the articles, on which the articles to be transferred are carried in line in a continuous way. According to the method, the articles leaving said outlet line, aligned and regularly spaced apart, are transferred onto support elements carried by a distributing unit aligned with the outlet line, above the feeding line. The support elements are selectively operated to release one by one said articles into respective holding pockets defined by the feeding line.

5 Claims, 6 Drawing Sheets

W
Y
13
8
A0
B0
PA
9a
2a
PB
T0
A1
B1
9b
2b
B2
A2
10

A0
B0
9a
2a
A1
B1
9b
2b
B2
T0
A2
12
PB
PA
9c
A3
B3

W
Y
13
8
A0
A1
A2
A3
A4
B0
B1
B2
PA
PB
T0
9a
2a
2b
2c
2d
12
10

13
8
A3
B0
2c
2a
2d
2b
A4
B1
T0
2e
A5
B2
12
B3
W
Y
A7
A6
2f
PA
PB
10

METHOD AND A DEVICE FOR TRANSFERRING ARTICLES, IN PARTICULAR BLISTER PACKS, TO THE FEEDING LINE OF A PACKAGING MACHINE

FIELD OF THE INVENTION

The present invention relates to the technical field concerning the packaging of articles, in particular blister packs and the like.

More in detail, the invention relates to a method for transferring articles, such as blister packs and the like, to the feeding line of a packaging machine, and to a device which carries out this method.

DESCRIPTION OF THE PRIOR ART

One of the problems of the above specified field is related to transferring blister packs, as taken from the outlet line of the blistering machine, arranged in piles, to the packaging machine.

According to a known solution, the transferring is performed with the help of a vertical magazine, in which the blister packs, coming from the outlet line of the blistering machine, are received and orderly piled up, one on another.

Then, the piled up packages are separated, grouped and removed from the bottom of the magazine and subsequently, they are introduced into boxes.

According to another known solution, the transferring is performed with the help of an escapement device connected to a magazine oscillating with respect to an axis perpendicular to the translation direction of a conveyor, situated below and equipped with a plurality of holding pockets aimed at receiving blister packs coming from the bottom of the magazine.

The escapement device can release intermittently a predetermined number of blister packs into each holding pocket of the conveyor.

The described devices for transferring blister packs are generally inconvenient, specially as far as the connection between the blistering machine and the packaging machine is concerned.

Actually, these systems feature the disadvantage resulting from the inconsistency between the continuous flow of the packages at the outlet of the blistering machine and the discontinuous feeding of the packaging machine.

In order to avoid the above drawback, a method has been proposed for transferring blister packs to the feeding line of a packaging machine, moving continuously, described in the patent application Ser. No. BO2002A000357 filed by the same Applicant.

According to this method, at least one group of blister packs is withdrawn from the outlet line of the blistering machine by a gripping member of a robot means, which moves in the same forward direction as the outlet line, so as to follow the movement of the latter.

The group of blister packs is transferred to the feeding line, following the movement of the latter.

The innovative solution described in that patent application is destined to be preferably applied to most advanced and sophisticated machines.

SUMMARY OF THE INVENTION

The object of the present invention is to propose a method which allows transferring of blister packs from the outlet line of a blistering machine to the feeding line of a packaging machine performed in an automatic, simple and continuous way.

Another object of the present invention is to propose a method according to which the blister packs are transferred in a way such as to form ordered piles on the feeding line of the packaging machine.

A further object of the present invention is to propose a device which allows to carry out the proposed method with a simple and versatile structure.

The above mentioned objects are obtained, in accordance with the contents of the claims, by means of a method for transferring articles, in particular blister packs, to the feeding line of a packaging machine, moving continuously and longitudinally with respect to an outlet line of a machine producing said articles, on which outlet line said articles to be transferred are moved arranged in a row and in a continuous way, the method including the following steps:

transferring said articles leaving said outlet line, aligned and regularly spaced apart, onto support elements carried by distributing means aligned with said outlet line, above said feeding line;

selective operating of said support elements to release one by one said articles into respective holding pockets defined by said feeding line.

The above mentioned method is carried out by a device for transferring articles, in particular blister packs, to the feeding line of the packaging machine, moving continuously and longitudinally with respect to an outlet line of the machine producing said articles, on which outlet line said articles to be transferred are carried in a row and in a continuous way, the device including:

distributing means for the articles to be transferred, said distributing means being arranged in alignment with conveying means of said outlet line, above said feeding line, and equipped with support elements for receiving said articles and designed to be operated selectively to release said articles into respective holding pockets defined by conveying means of said feeding line; and additional conveyor means for transferring said articles, aligned and regularly spaced apart, from said conveying means of said outlet line to said distributing means.

BRIEF DESCRIPTION OF THE DRAWINGS

The characteristic features of the present invention will be pointed out later on, with reference to the enclosed drawings, in which.

DESCRIPTION OF THE PREFERRED EMBODIMENTS

Figure 1:
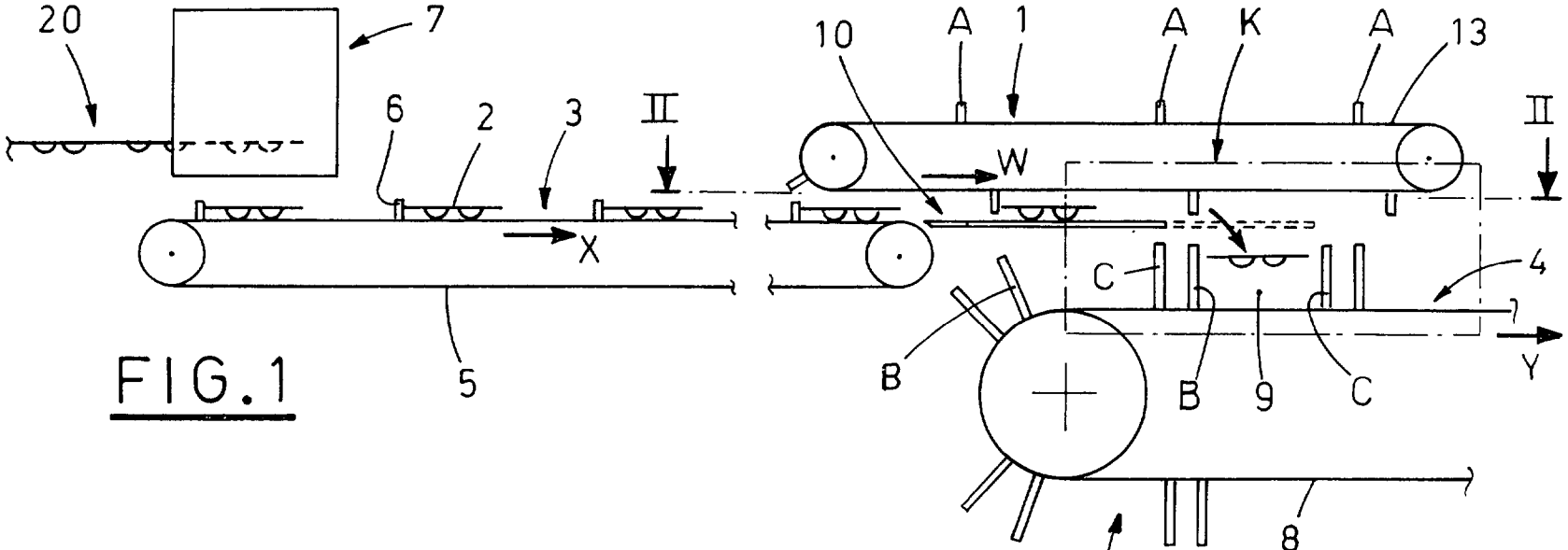
FIG. 1 is a lateral view of a device for transferring blister packs to the feeding line of a packaging machine.

With reference to the above figures, reference numeral 1 indicates the device for transferring articles 2, in particular blister packs, from the outlet line 3 of a blistering machine to the feeding line 4 of a packaging machine.

The outlet line 3 of the blistering machine and the feeding line 4 of the packaging machine are arranged in alignment with each other, along a longitudinal direction.

The outlet line 3 of the blistering machine includes substantially a conveyor belt 5, which is operated to move continuously, and which carries the blister packs 2 in piles into respective holding pockets defined by regularly spaced apart prongs 6.

The single blister packs 2 are fed at regular intervals by the cutting station 7 of the blistering machine, where the blister packs 2 are cut off from the blister band 20, to the holding pockets.

The feeding line 4 of the packaging machine includes a conveyor belt 8, operated to move continuously and having respective holding pockets 9, regularly spaced apart and aimed at receiving the above mentioned blister packs 2.

Each holding pocket is defined, in known way, by rear prongs B facing fore prongs A.

The transferring device 1 includes a selective distributing unit 10, situated near the area, where the blister packs 2 leave the outlet line 3 of the blistering machine, above the conveyor belt 8 of the feeding line 4 of the packaging machine.

The distributing unit 10 includes a pair of lateral boards 11 containing the blister packs 2 and arranged longitudinally to the conveyor belt 5 of the outlet line 3 of the blistering machine.

A plurality of retractable support elements 12 extend symmetrically from the boards 11 and are operated selectively by respective actuator means, not shown.

The distributing unit 10 extends longitudinally to the conveyor belt 5, so as to support the blister packs 2 leaving the conveyor belt 5 arranged in a row, i.e. supported on both sides by the retractable support elements 12.

It is to be noted that the support elements 12 define a resting plane for the blister packs 2, which is aligned horizontally with the upper active run of the conveyor belt 5 and, substantially, constitutes its extension.

The blister packs 2 leaving the conveyor belt 5 are transferred, while being kept in a row, onto the support elements 12 by additional belt conveying means 13, which are situated above the adjacent portions of the outlet line 3 of the blistering machine and the feeding line 4 of the packaging machine, longitudinally aligned therewith.

The additional conveyor belt 13 is equipped with prongs A, regularly spaced apart, which, while moving along the lower active run of the additional conveyor belt 13, have the task of transferring, in a row, and push blister packs 2, resting on the support elements 12 of the distributing unit 10, from the conveyor belt 5.

For this purpose, the additional conveyor belt 13 is operated with a speed W, suitably bigger that the speed Y of the conveyor belt 8 of the feeding line 4 of the packaging machine, and higher than the speed X of the conveyor belt 5 of the outlet line 3 of the blistering machine, as will be better explained later.

The proposed method includes substantially the transferring of the blister packs 2 leaving the conveying belt of the outlet line 3 of the blistering machine, aligned in a row and orderly spaced apart, onto the retractable support elements 12 of the distributing unit 10.

This transferring is performed by the additional conveyor belt 13, whose prongs A engage the rear part of the blister packs 2 and move them on the plane defined by the support elements 12.

The additional conveyor belt 13 moves with a speed W, which is bigger than the speed X of the conveyor belt 5, in order to allow the blister packs 2 to move far from the pushing lug 6 of the conveyor belt 5 to prevent the lug from interfering with the blister pack and consequently, damaging it, during rotation to run the return path.

The blister packs 2 are supported on both sides by the support elements 12 and are situated between the lateral boards 11 of the distributing unit 10, so as to maintain a correct reciprocal alignment.

Figure 2:
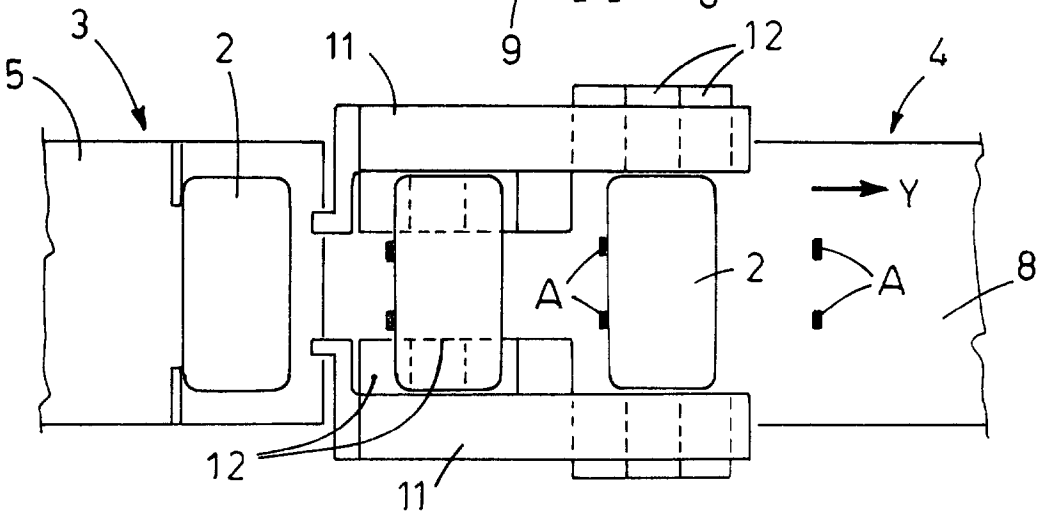
FIG. 2 is a corresponding partial top view, along the plane II—II of FIG. 1.

In suitable step relation with the forward movement of the conveyor belt 8 of the feeding line 4, the support elements 12 are operated selectively to retract, so as to release, one by one, the blister packs 2 into the respective holding pockets 9 defined by the prongs B, C of the above mentioned conveyor belt 8 (see FIGS. 1 and 2).

More in particular, in order to package single blister packs 2 into relative boxes, the blister packs 2 are released one by one, each into a respective holding pocket 9 of the feeding line 4 of the packaging machine.

Figures 3A, 3B:
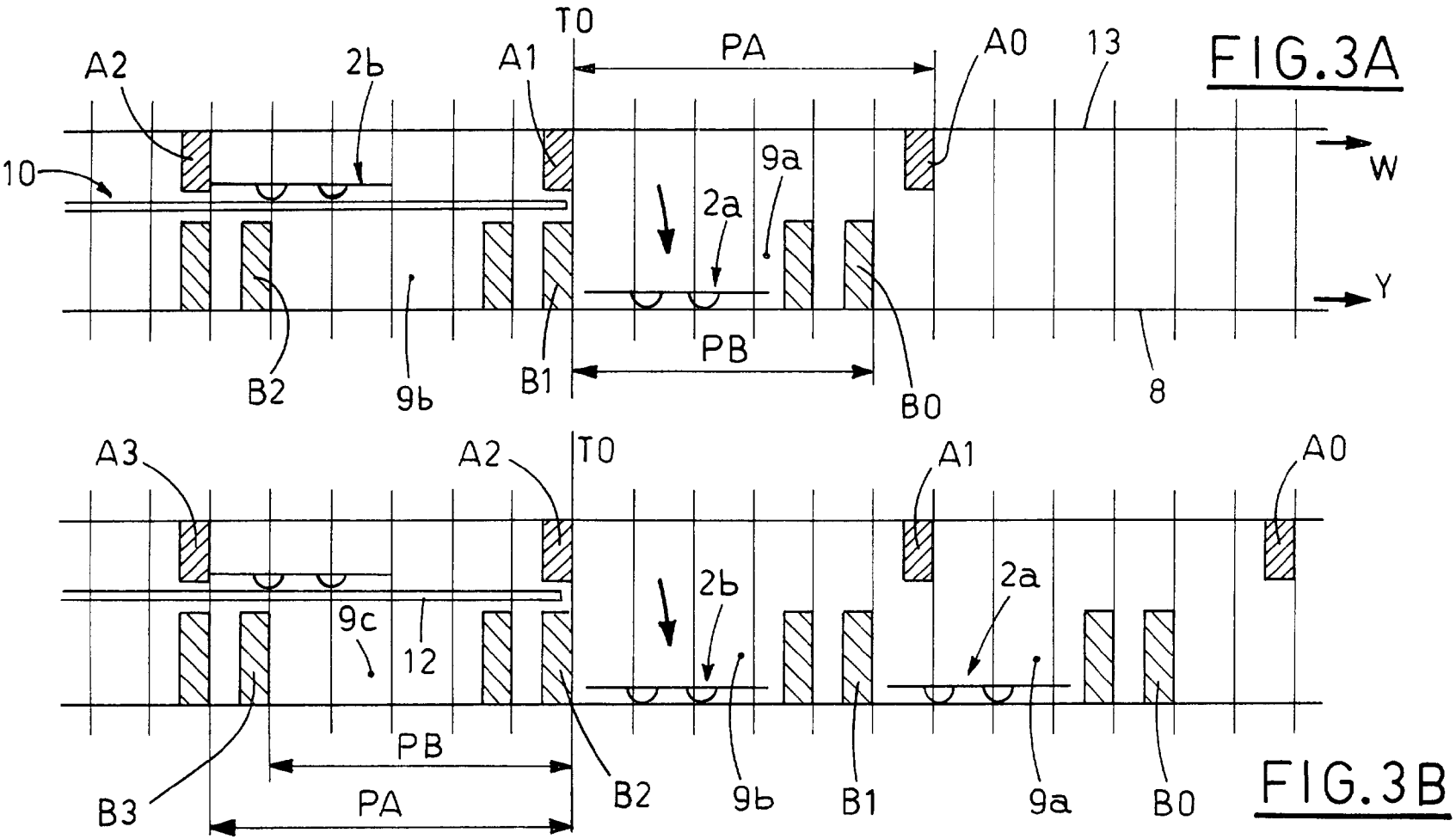
FIGS. 3A and 3B are lateral schematic views of an enlarged portion of the device, corresponding substantially to the portion K of FIG. 1, during subsequent transferring steps of the blister packs, for packaging single blister packs, according to the proposed method.

Reference numerals A0, A1, A2, A3 in FIGS. 3A, 3B indicate four consecutive prongs of the additional conveyor belt 13, while B0, B1, B2, B3 indicate as many consecutive rear prongs relevant to consecutive holding pockets 9*a*, 9*b*, 9*c* of the conveyor belt 8.

Let's take into consideration the moment T0, in which a first blister pack, indicated with 2*a* for netter clarity, has been just released by the distributing unit 10 into a respective holding pocket 9*a* of the conveyor belt 8 situated below, and a prong A1 of the additional conveyor belt 13 is aligned with a corresponding rear prong B1 of the conveyor belt 8.

The next blister pack, indicated with 2*b*, will be released into the next holding pocket 9*a*, when the additional conveyor belt 13 and the conveyor belt 8 have completed a step PA and PB, respectively, i.e. when the next pair of prongs A2 and B2 of the belts 13, 8, respectively, are reciprocal alignment (FIG. 3B).

The step PA, PB is defined by the distance between the teeth A0, A1, A2, A3 and B0, B1, B2, B3, respectively, i.e. by the distance the prongs A2, B2 must cover to reach the position, which was previously occupied by the prongs A1, B1.

Obviously, it is necessary that the conveyor belts 13 and 8 perform the steps PA and PB at the same time.

The width of the step PB of the conveyor belt 8 is smaller than the width of the pass PA of the additional conveyor belt 13, so the speed Y of the first is correspondingly smaller than the speed W of the second one.

It is also possible to obtain piles of a suitable number of blister packs 2 inside the holding pockets 9 defined by the prongs B, C of the conveyor belt 8, to be packed in a single package.

Figure 4A:
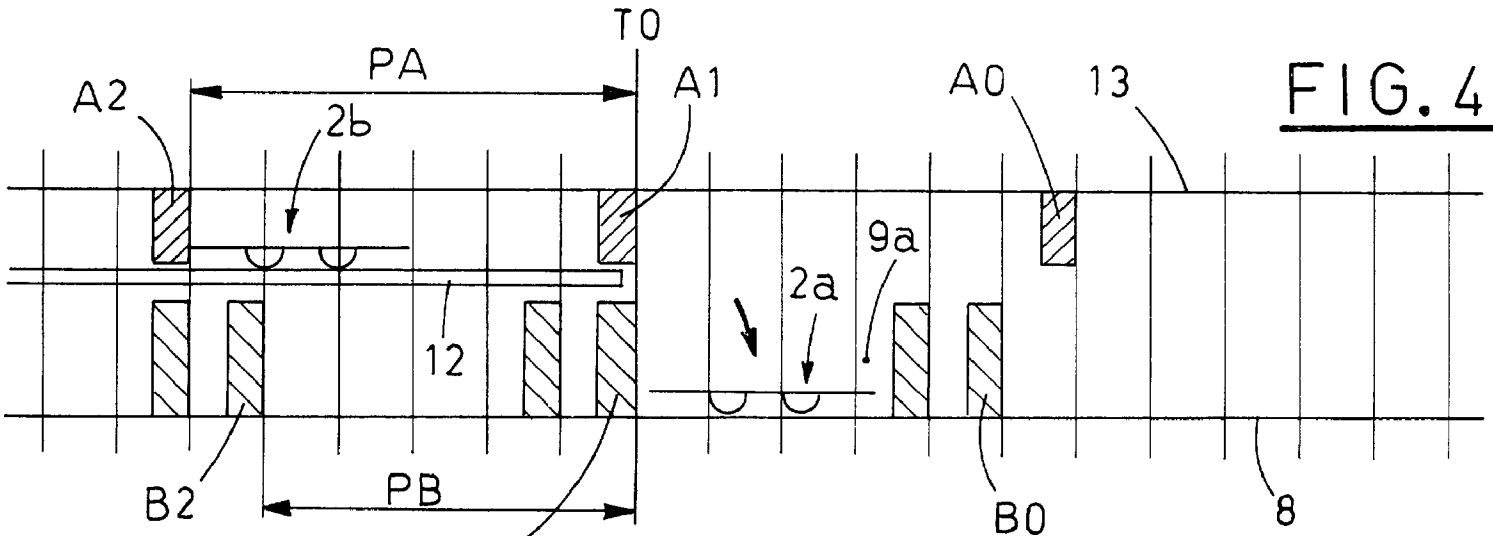
FIGS. 4A, 4B, 4C and 4D are the same lateral and schematic views of the device, during subsequent transferring steps of the blister packs for forming piles consisting of two blister packs.
Figure 4B:
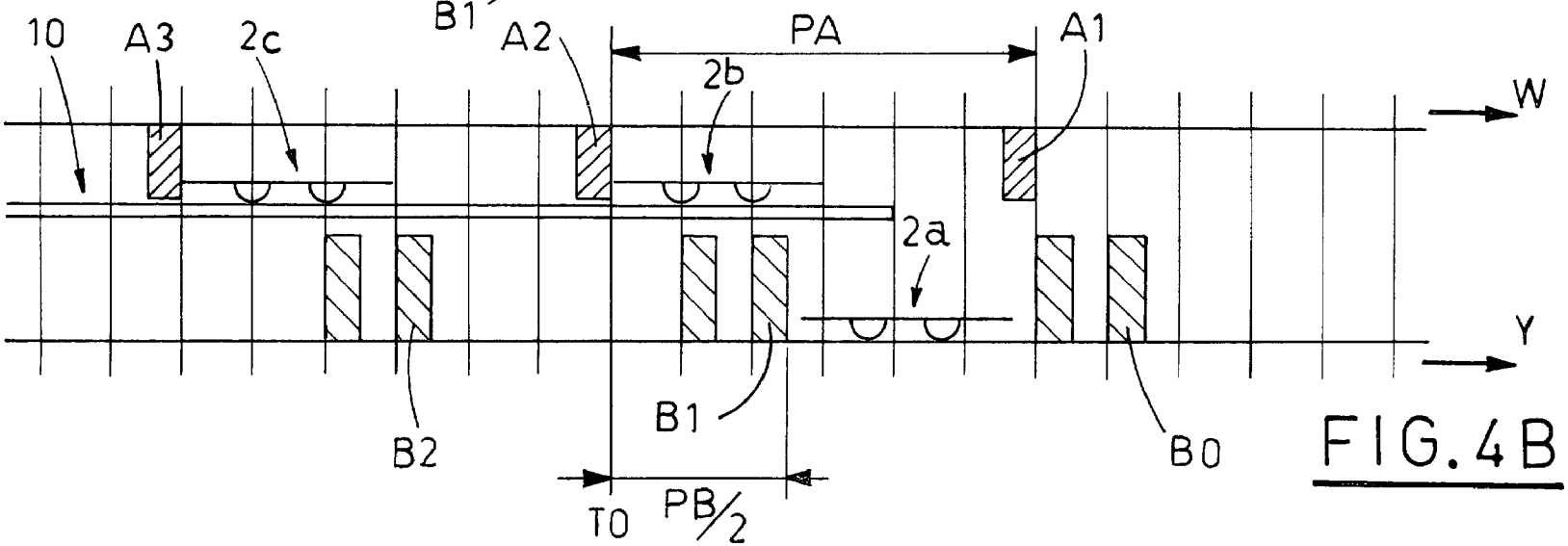
Figure 4C:
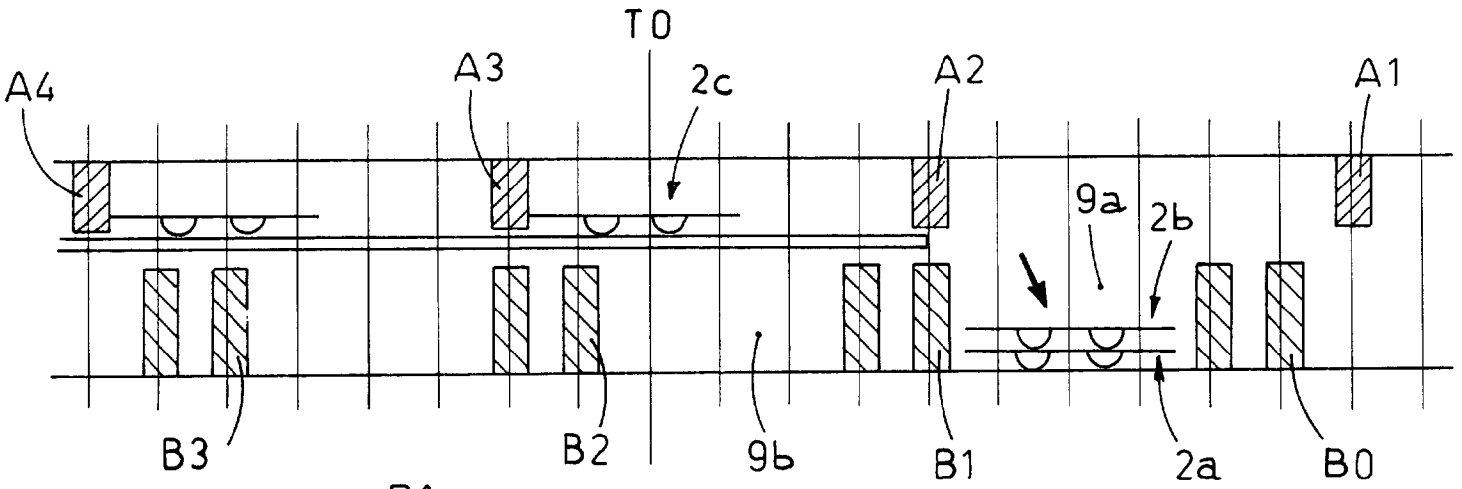

FIGS. 4A, 4B and 4C show schematically, in example way, the forming of piles of two blister packs 2, beginning from the step, in which a first blister pack 2*a* has been released by the distributing unit 10 into a respective holding pocket 9*a* of the conveyor belt 8.

In this moment T0, mutual position of the prongs A1 and B1 of the conveyor belts 13 and 8 is predetermined as it will be explained in the following: FIG. 4A shows, for example, the two conveyor belts in reciprocal alignment.

After the blister pack blister packs 2*a* has been released, the support elements 12, previously brought to the retracted position, are operated to return to the active position, in which the support the blister packs 2 moving forward on the distributing unit 10.

Therefore, next blister packs 2*b*, 2*c*, move, being pushed by respective prongs A2, A3, of the additional conveyor belt 13, on the support plane defined by the above mentioned support elements 12, until, due to missing support, a second blister pack 2*b* is released into the holding pocket situated below, where the first blister pack 2*a* has been released previously (FIGS. 4B, 4C).

It is to be noted that during this step, the prongs A2 and B1 have been brought to reciprocal alignment due to the higher speed of the additional conveyor belt 13.

Figure 4D:
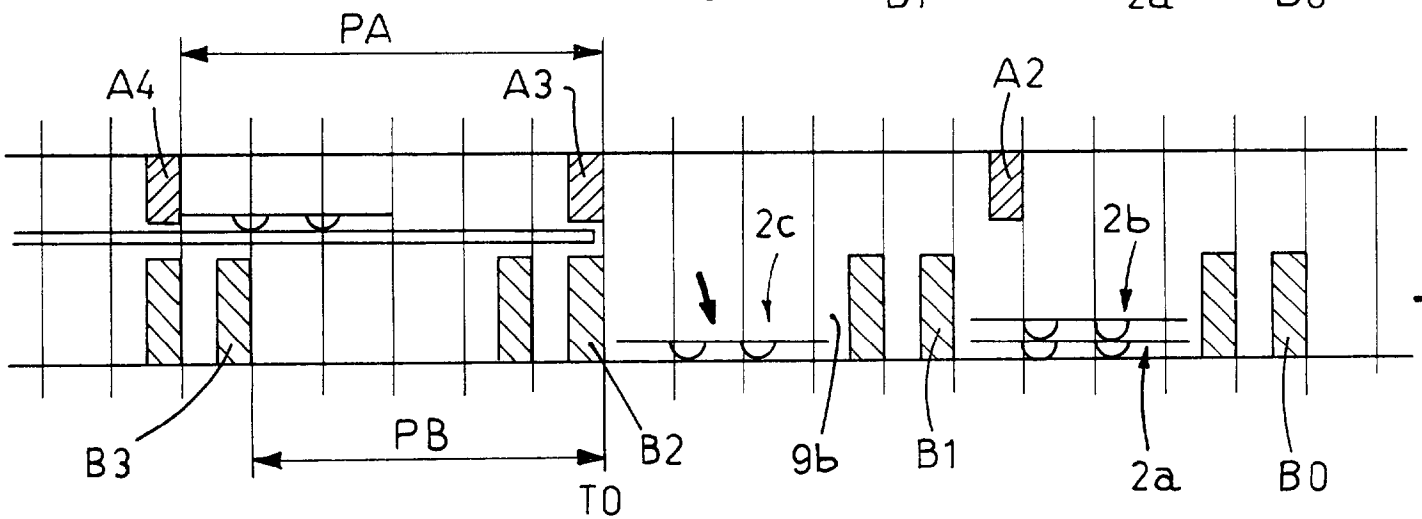

The next blister pack 2*c* is released into the subsequent holding pocket 9*b* when the additional conveyor belt 13 and the conveyor belt 8 have completed, respectively two steps PA and one step PB, with respect to the moment T0, i.e. when a next pair of prongs A3 and B2 are in reciprocal alignment (FIG. 4D).

In that moment, the support elements 12 are operated to retract on both sides, in the region corresponding to the holding pocket situated below, so as to make the blister pack 2*c* fall down.

FIGS. 5A, 5B, 5C, 5D, 5E and 5F show schematically, still as an example, the forming of piles of five blister packs 2, beginning from the step, in which a first blister pack 2*a* has been released by the distributing unit 10 into a respective holding pocket 9*a* of the conveyor belt 8, with the prongs A1, B1 of the conveyor belts 13 and 8 arranged, one with respect to the other, in a predetermined way: FIG. 5 shows them in mutual alignment for explanation easiness.

After the blister pack 2*a* has been released, a part of the support elements 12, previously brought to the withdrawn position, are operated to return to the active position, in which they support the blister packs 2 moving forward on the distributing unit 10.

Therefore, the next blister pack 2*b* moves forward, pushed by respective prongs A2 of the additional conveyor belt 13, on the support plane defined by said support elements 12 until, due to the support being missing, the second blister pack 2*b* is released into the holding pocket situated below, where the first blister pack 2*a* has been released previously: this occurs when the mutual position of the prongs A2, B1 (FIG. 5B) is analogous to the mutual position of the prongs A1, B1 in FIG. 5A, e.g. in mutual alignment.

Figures 5A, 5B, 5C:
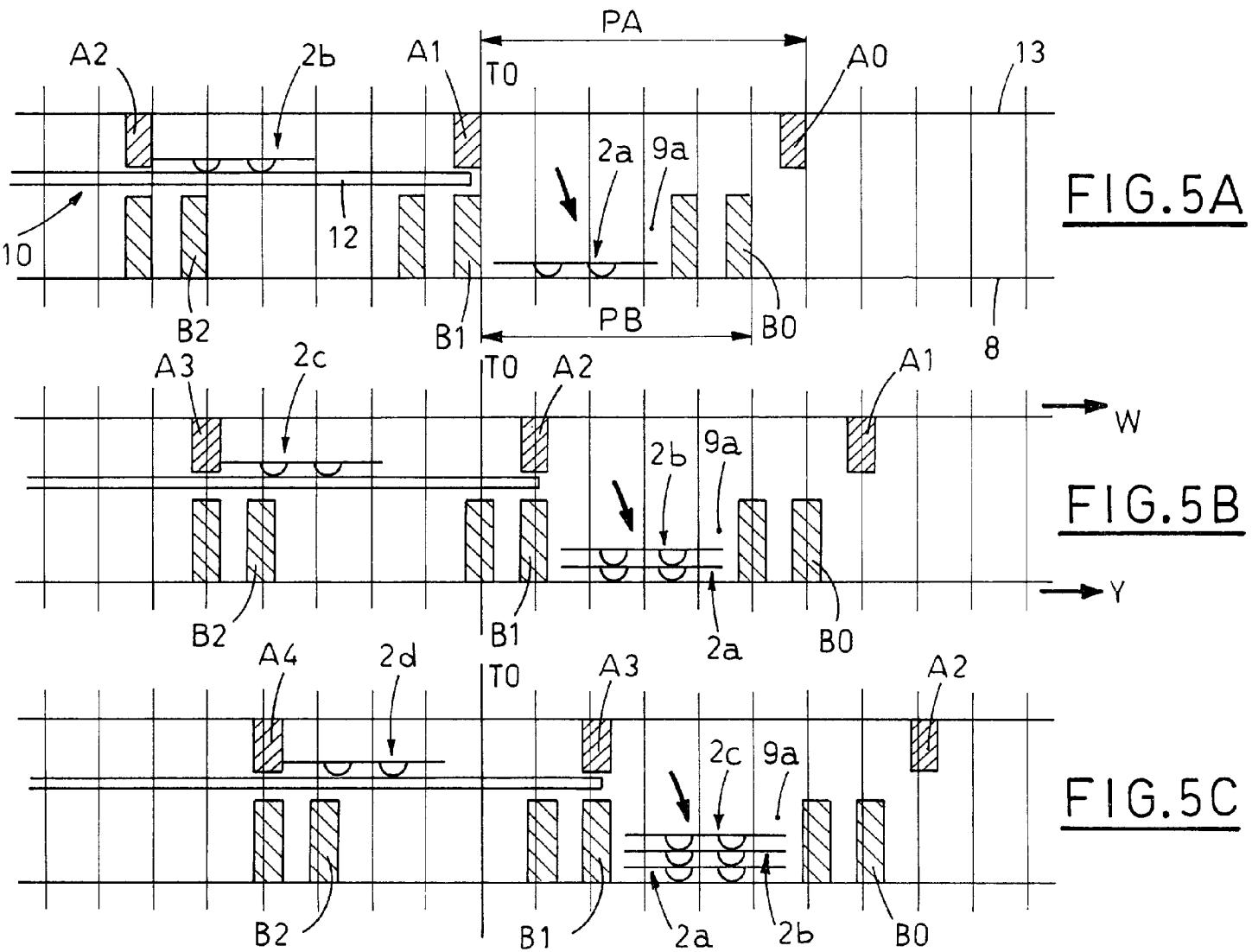
FIGS. 5A. 5B, 5C, 5D 5E and 5F are the same lateral and schematic views of the device, during subsequent transferring steps of the blister packs for forming piles consisting of five blister packs.

Likewise, the next third blister pack 2*c* moves forward, pushed by respective prongs A3 of the additional conveyor belt 13, on the support plane defined by said support elements 12, another part of which has been shifted to the active support position, until, the third blister pack 2*c* is released into the holding pocket 9*a* situated below, where the blister packs 2*a* and 2*b* have been released previously (FIG. 5C).

This occurs when the mutual position of the prongs A3, B1 is analogous to the mutual position of the prongs A1, B1 in FIG. 5A.

Likewise, a fourth blister pack 2*d* (FIG. 5D), and a fifth blister pack 2*e* (FIG. 5E), are released into the above holding pocket 9*a*, moved by respective prongs A4, A5 of the additional conveyor belt 13 on the support plane defined by the support elements 12, progressively shifted to the active position, in which they support blister packs.

It is to be noted that due to the higher speed of the additional conveyor belt 13, the prongs A1, A2, A3, A4 and A5 are brought in alignment with the prong B1 of the conveyor belt 8 of the outlet line, on the margin of the support elements 12 operated to active position, when the blister packs 2*a*, 2*b*, 2*c*, 2*d* and 2*e* are released.

Figures 5D, 5E, 5F:
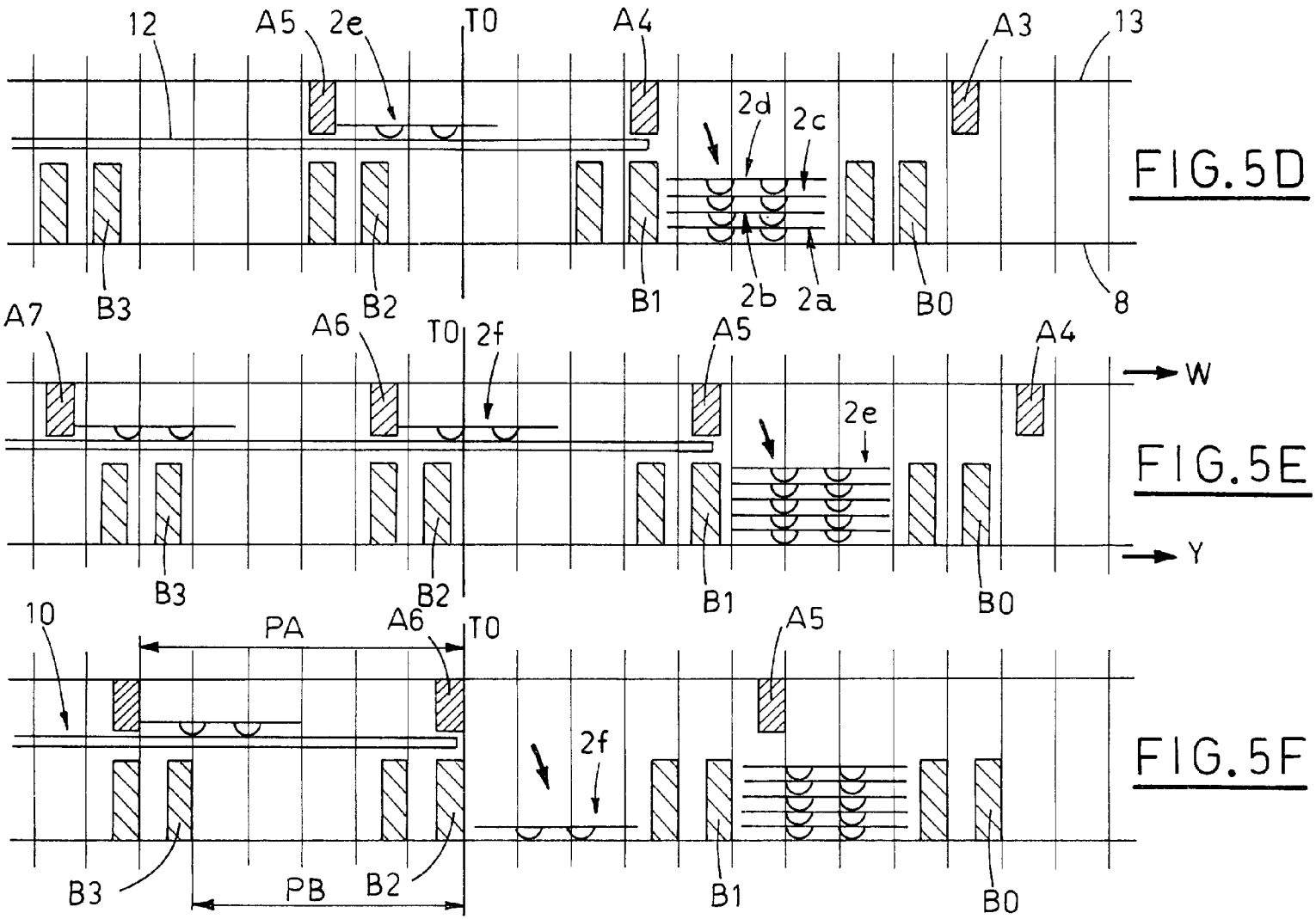

When the pile of five blister packs is completed in the holding pocket 9*a*, all the support elements 12, previously operated selectively, return to the initial retracted position, when the prongs A6 and B2 match each other, so as to allow the release of a first blister pack 2*f* of a new pile to be formed in a subsequent holding pocket, defined by the prongs of the conveyor belt 8 (FIG. 5F).

Then, the cycle of forming the pile of blister packs goes on like the previously described one.

It is to be pointed out that a blister pack is released into the related holding pocket 9 in function to the moment, in which a prong A of the belt 13 and a prong B of a relative holding pocket 9 are reciprocally aligned.

Advantageously, the release of the blister pack takes place before this moment, and the entity of this anticipation depends on the speeds W, Y of the belts 13, 8 and on the characteristics of the blister packs (weight, dimensions, etc.).

Consequently, the blister packs 2 are transferred from the belt 5 to the support elements 12, which release them to the holding pockets 9 of the belt 8 situated below.

Therefore, the described method fulfills the object to transfer automatically and continuously blister packs from the outlet line of a blistering machine to the feeding line of a packaging (boxing) machine.

As it appears, the proposed method allows to take over, in an easy way, the blister packs 2 from the outlet line 3 of the blistering machine moving continuously and to transfer them orderly to the feeding line 4 of the packaging machine, moving likewise continuously.

This solution allows high working speed to be obtained and consequently maximum use of the machine productive capacity to be exploited.

Obviously, it is possible to transfer single blister packs or to obtain piles formed by a different number of blister packs, changing correspondingly the speed of the conveyor belt 8 with respect to the speed of the conveyor belt 5 and the selective retraction of the support elements 12 of the distributing unit 10.

Practically, the speed W of the additional conveyor belt 13 is equal to the width of the step PA between the prongs A multiplied by the number of blister packs 2 to be released in the time unit, while the speed Y of the conveyor belt 8 is equal to the width of the step PB between the prongs B multiplied by the number of blister packs 2 to be released in the time unit, the whole divided by the number of the blister packs 2 to be piled up inside the holding pockets 9 of the conveyor belt 8.

Electronic control means suitably control the selective retraction of the support elements 12, described previously, in the virtual matching point of the prongs A and B, so as to take into consideration possible inertia effects connected to the speed of the conveying means.

It is to be pointed out that the proposed method is carried out by a device, which is very simple structurally and functionally as well as versatile.

What is claimed is:

1. A method for continuously transferring articles from an outlet line to a moving feeding line of a packaging machine comprising:

continuously moving said articles longitudinally with respect to the outlet line;

continuously arranging said articles on the outlet line so that the articles are aligned and regularly spaced apart, providing distributing means aligned in a same direction as said outlet line and located above said feeding line, a plurality of separately operable support elements carried by said distributing means;

transferring said articles leaving said outlet line onto said support elements carried by said distributing means aligned with said outlet line and located above said feeding line; and, selectively operating individual support elements one at a time for releasing and transferring said articles one by one into respective holding pockets in said continuously moving feeding line, when a respective holding pocket is aligned with a respective support element.

2. The method according to claim 1 further comprising providing an additional conveyor means (13) for transferring said articles to said distributing means, and, selectively operating the support elements for retracting the support elements and releasing said articles, and for moving said support elements to an active position in which they support the articles before release, in a relation timed with a forward movement of the additional conveyor means.

3. The method according to claim 1 further comprising moving said articles supported by said support elements along said distributing means, at a speed higher than a forward movement speed of said feeding line.

4. The method according to claim 3, wherein said article movement speed on said distributing means is equal to a length of time for successively pushing each article on said distributing means multiplied by a number of articles to be released per unit of time.

5. The method according to claim 1 further comprising releasing said articles into the respective holding pockets at the moment when a pushing means, for acting on said articles on said distributing means, are aligned with said respective holding pockets.

* * * * *